US005133125A

United States Patent [19]

Diebels et al.

[11] Patent Number: 5,133,125

[45] Date of Patent: Jul. 28, 1992

[54] METHOD FOR THE MANUFACTURE OF A ROLLER, AND ROLLER THUS OBTAINED

[75] Inventors: Bernard P. Diebels, Maasbree; Ronald Ekkel, Cuijk; Anthonius M. van der Meulen, Helmond, all of Netherlands

[73] Assignee: Stork Screens B. V., Netherlands

[21] Appl. No.: 670,052

[22] Filed: Mar. 15, 1991

[30] Foreign Application Priority Data

Mar. 20, 1990 [NL] Netherlands ..... 9000645

[51] Int. Cl.[5] ..... B23P 17/00; B21B 31/08

[52] U.S. Cl. ..... 29/527.2; 29/123; 29/895.2; 29/895.32

[58] Field of Search ..... 29/123, 895, 895.2, 29/895.22, 895.32, 527.2

[56] References Cited

U.S. PATENT DOCUMENTS 2,615,389 10/1952 Huebner .
3,378,902 4/1968 Hoexter ..... 29/895.22 X
4,062,098 12/1977 Brugman .

FOREIGN PATENT DOCUMENTS 0253981 1/1988 European Pat. Off. .
3840951 2/1990 Fed. Rep. of Germany .
2009674 6/1979 United Kingdom ..... 101/129

*Primary Examiner*—Carl J. Arbes
*Attorney, Agent, or Firm*—Ostrolenk, Faber, Gerb & Soffen

[57] ABSTRACT

Described is a method for manufacturing light weight roller in which a thin metal roller casing, such as a thin electroformed sleeve, is centered by journals after which inside the roller casing a low density filling is applied. The low density filling may be a set plastic foam or gas under pressure. In a further embodiment a metal inner roller casing is present which is concentric with an outer roller casing. The space inside the inner casing and the space between the inner casing and the outer casing may be filled with a low density material. Also is described a roller thus obtained having a roller casing of electroformed nickel of a thickness between 100 and 500 μm.

19 Claims, 3 Drawing Sheets

METHOD FOR THE MANUFACTURE OF A ROLLER, AND ROLLER THUS OBTAINED

BACKGROUND OF THE INVENTION

The invention relates to a method for the manufacture of a roller with a form-retaining external surface in which a cylindrical metal roller casing is centered relative to roller shaft means.

Such a method is generally known and is used, for example, for the production of guide rollers forming part of devices in which web-type material, for example plastic film, has to be conveyed during its formation or during the carrying out of a surface treatment such as printing and the like.

Such guide rollers are for cost reasons preferably not driven and are assumed to run along with the film through friction. However, such rollers often have a tendency to slip along the substrate, for example through dragging bearings or through the value of the starting couple needed to put such a roller into operation.

When a non-driven roller slips, the air film between the roller surface and moving film substrate can have an effect on the substrate which can mean that when, for example, a coating is being applied to the substrate unevenness occurs, for example in the form of a stripy finish.

The object of the present invention is to provide a method for the manufacture of a roller of the type indicated above which does not have the above-mentioned disadvantages.

SUMMARY OF THE INVENTION

According to the invention, the method is to that end characterized in that:

it starts from a thin metal roller casing which is manufactured by electrodeposition of metal on a cylindrical metal mold and which is removed from the mold, the roller shaft means are in the form of journals fixed in both ends of the roller casing, and the roller casing is given rigidity by providing a low-density filling inside the roller casing.

The filling inside the casing can be of many kinds of low-density products such as plastic granules, granules of inorganic material, densely packed organic or inorganic fibers etc.

However, the filling is expediently made of a foam plastic which is introduced in liquid form and subsequently allowed to set.

Otherwise the filling can be made of a gas under pressure; by using air under a pressure of at least 1.3 atm. (gauge) sufficient rigidity of the roller casing is obtained for it to be used as a substrate guide roller.

In the method indicated above an extremely thin and thus light roller casing is centered relative to roller shaft means which are made in the form of journals. Through these measures a great saving in weight is achieved, as a result of which in particular the starting couple of such a roller is considerably reduced.

Providing a plastic foam product which is allowed to set or a filling of gas under pressure in the inside means that the roller is sufficiently rigid to be resistant to deformation during use thereof.

The roller obtained by the method according to the invention is therefore extremely light and easy to handle and also has sufficiently great rigidity to be resistant to sagging during its use in devices of various types.

In connection with the method described above, reference is also made to Dutch Patent Application 87 02278, which has been laid open for inspection. The above-mentioned publication describes a roller comprising a casing of elastic material and a shaft, in which a set foam-type material is present between the casing and the shaft.

Such a known roller is obtained by placing an elastic material against the inside of a hollow mold already containing a through shaft, and then filling the space between the shaft and the elastic material with a foaming material which through its expansion force presses the elastic material against the inside of the hollow mold. In this way, after setting, a centering of the elastic material around the shaft is obtained, with the space between casing and shaft being filled with set foam plastic.

This known method does not deal with the provision of a thin metal roller casing which is centered by means of journals at both ends thereof, and in which the rigidity of such a roller is obtained by filling the cavity with set foam plastic.

In particular, in the method according to the invention described above the roller casing is subjected to a surface treatment before being removed from the mold on which it is formed, in order to give the external surface of the roller casing a texture which is desired for subsequent use.

If a guide roller in general is run in a film conveyance device, its smooth surface can give rise to the formation of an air film between the roller surface and the conveyed film, which can result in unevenness occurring, for example during coating or generally treating the conveyed film.

In the case of heavier guide rollers it is known to provide the surface with contours which permit air conveyance, so that the formation of an air film between the roller and the plastic film is largely prevented.

In the case of the rollers according to the state of the art at least the roller casing must be of a certain minimum thickness in order to permit such surface treatments.

The roller casing used in the method according to the invention is very thin; nevertheless, surface treatments can still be carried out without any problem if during the treatment the roller casing is left on the surface of the mold on which the roller casing is formed in an electrodeposition operation.

There can be many different types of surface treatments, for example making grooves or recesses, grinding, turning, etching, the electrodeposition of additional metal layers or metal patterns, or full or partial coating with plastic.

The treatments indicated above can be used in general for the application of surface contouring or the removal of undesirable surface roughness, the provision of, for example, hard or wear-resistant surface layers or the formation of surface patterns by electrodeposition using photolithographic techniques.

For certain applications it is not necessary for the entire space inside the roller casing to be filled with the same product. It is advantageous in the method to fix concentrically with the roller casing a metal inner casing with an external diameter which is smaller than the internal diameter of the roller casing using journals which permit centered accommodation of both the roller casing and inner casing, while at least the space between the roller casing and the inner casing is filled with a low-density filling.

The space inside the inner casing can also be filled with a low-density filling.

It is advantageous for both the space between the roller casing and the inner casing and the space inside the inner casing to be filled with a foam plastic which is allowed to set, a high-density product preferably being selected for the foam plastic inside the inner casing, and a product of lower density preferably being selected for the foam plastic between the inner casing and the roller casing.

In this way a roller with great resistance to sagging is also obtained. The inside of the roller can also be kept free for, for example, the accommodation of any additional structures for increasing the rigidity of the roller for those cases where very high standards as regards resistance to sagging are set.

In the manufacture of the roller in the method according to the invention, temporary centering sealing plugs can be used during the filling with plastic foam product and are removed after setting of the foam product and replaced by the required journals.

Such journals and/or sealing plugs can also be provided with several apertures which open out on their periphery and are connected to a connection for the infeed of a medium under pressure such as compressed air, and for the insertion and removal of such journals and/or sealing plugs through the infeed of medium under pressure the diameter of the roller casing and inner casing, if present, is temporarily enlarged at the ends, following which placing or removal of the journals or sealing plugs takes place.

If desired, the roller casing can be provided with a covering such as an adhering plastic covering of, e.g., rubber in order to give the roller non-slipping properties.

The covering can also be a close-fitting metal sleeve. This metal sleeve can be fitted around the roller casing by using the earlier described technique of temporarily enlarging the diameter of a casing.

The invention also relates to a roller comprising a roller casing which is centered relative to roller shaft means and which is obtained by means of the above-described method according to the invention, and which is characterized in that the roller casing is a seamless nickel sleeve of a thickness between 100 and 500 microns.

BRIEF DESCRIPTION OF THE DRAWINGS

The invention will now be described with reference to the drawing, in which.

DESCRIPTION OF THE PREFERRED EMBODIMENT

Figure 1:
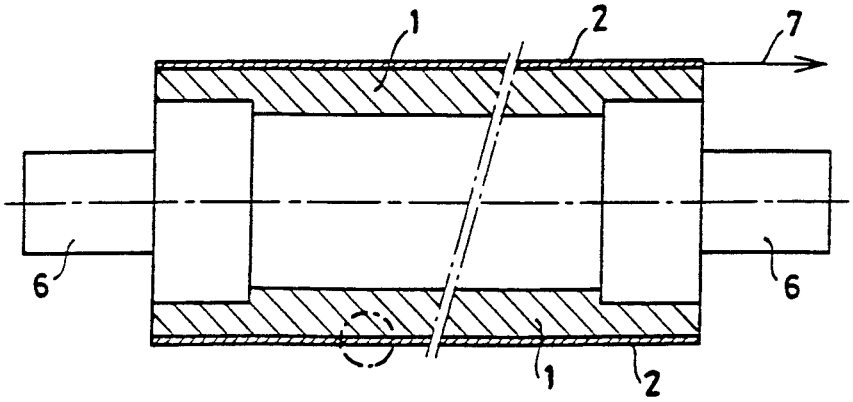
FIG. 1 shows a schematic view in cross-section of a mold on which a roller casing used in the method according to the invention is manufactured.
Figure 1A:
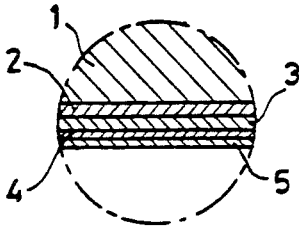
FIG. 1*a* is an enlargement of the cross-section of the roller casing according to first embodiment.
Figure 1B:
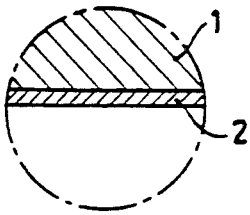
FIG. 1*b* is an enlargement of the cross-section of the casing according to a second embodiment.

FIG. 1 shows a mold body 1 on which a roller casing 2 is formed by means of electrodeposition techniques. The mold has journals 6 by means of which such a mold is rotatably mounted in an electrodeposition bath, for example a nickel bath or copper bath, in order to have the roller casing 2 deposited on the surface. As the enlarged cross-sections how, the roller casing 2 can be of a single metal layer (FIG. 1*b*), but it can also be a composite metal layer 2, 3, 4 and 5 (FIG. 1*a*). For example, layer 2 can be of nickel, layer 3 of copper, layer 4 of nickel and layer 5 of chromium; but other metal combinations can also be used, depending on the envisaged purpose.

Reference number 7 in FIG. 1 indicates that after a completed surface treatment of the roller casing 2 the roller casing can be slid off the mold as a result of the fact that the mold surface is provided with an adhesion-repellent surface coating. As indicated earlier, the surface treatment can be an electrodeposition treatment as indicated above in connection with FIG. 1, but a mechanical treatment such as the provision of grooves or recesses etc. can also be carried out, while a surface texture can also be formed in the roller casing 2, for example by means of a laser beam treatment.

Figure 2:
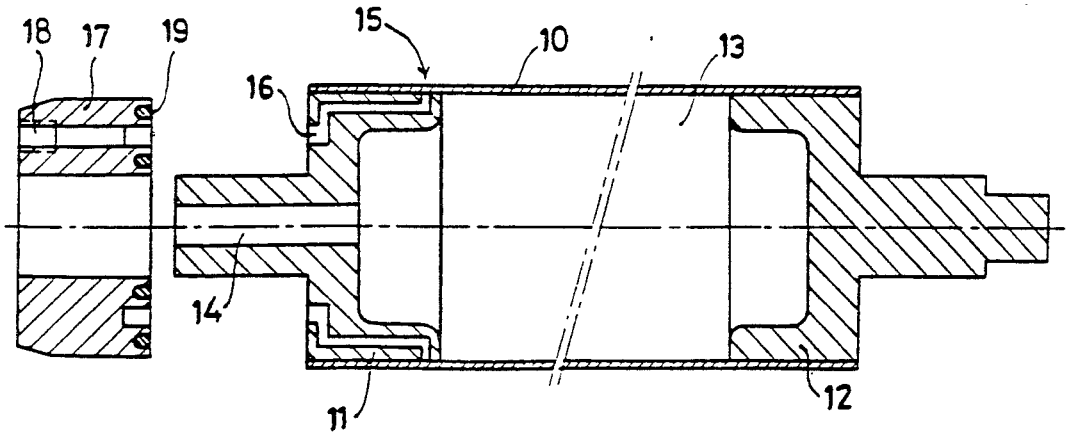
FIG. 2 shows a roller casing which is fitted on two journals.

FIG. 2 shows a roller casing 10 which is accommodated on two journals 11 and 12. The interior 13 of the roller thus formed is still free from foam plastic; this plastic can be fed in through aperture 14 in the journal 11. Reference number 15 indicates an aperture which opens out on the surface of the journal 11 and through which medium under pressure can be made to flow out during the fixing of the journal in the end of the roller casing 10.

For the infeed of medium under pressure such as compressed air use is made of a special adaptor which can seal off with sealing means 19 against the journal end and where a compressed air connection can be fixed in the aperture 18. By sliding a journal over a short distance in the roller casing end 10 and then feeding in compressed air such elastic stretching of the roller casing takes place that the journal can be slid without difficulty over its entire working length into the end of the roller. An ordinary journal 12 whose diameter is adapted precisely to the internal diameter of the roller casing is shown at the other side of the roller casing; with the use of such journals it is possible to produce a connection between the journal and the roller casing by, for example, gluing or soldering.

Figure 3:
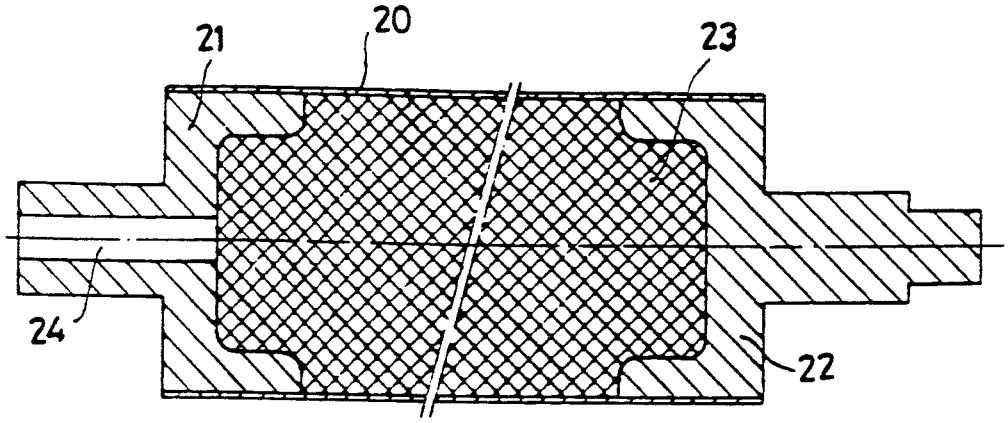
FIG. 3 shows a roller casing with journals in which the space inside the roller casing is filled with foam.

FIG. 3 shows a roller filled with foam, with a roller casing 20, journals 21 and 22, a foam plastic feed aperture 24 and a foam plastic filling 23. A suitable foam plastic is, for example, the polyurethane foam plastic HHR of Voss Chemie. This is a semi-rigid foam with up to 98% closed pores with a density of approximately 26 kg/m However, other types of foam can also be used.

Figure 4:
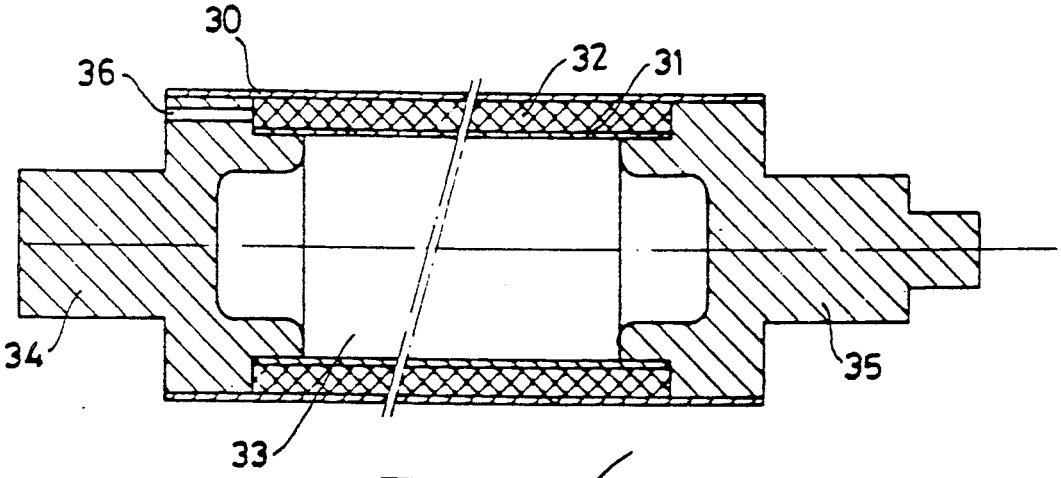
FIG. 4 shows a roller having a roller casing and an inner casing.

FIG. 4 shows an alternative form of a roller which can be obtained by the method according to the invention, with a roller casing 30 and an inner casing 31, the space 32 between the two casings being filled with a set foam product. The set foam product is fed in through the inflow aperture 36 in the journal 34, which is a special shape for this instance. The free space 33 can, if desired, be used for the provision of possibly light support structures which contribute to the rigidity of the roller.

The space 33 in FIG. 4 can also be filled with a plastic foam product. A foam product of higher density than the density of the foam product in space 32 is preferably used for this. For example, H450$^R$ of Voss Chemie with a density of 450 kg/m is used for the foam product in space 33. An alternative product for this is Baydur 600$^R$ of BASF. For the space 32 a product of lower density is used, for example HHR$^R$ of Voss Chemie with a density of 26 kg/m$^3$; an alternative for this is Bayflex 300$^R$ of BASF. Pressures of 5-6 atm. (gauge) are measured during the setting of the foam in the space 33.

Figure 5:
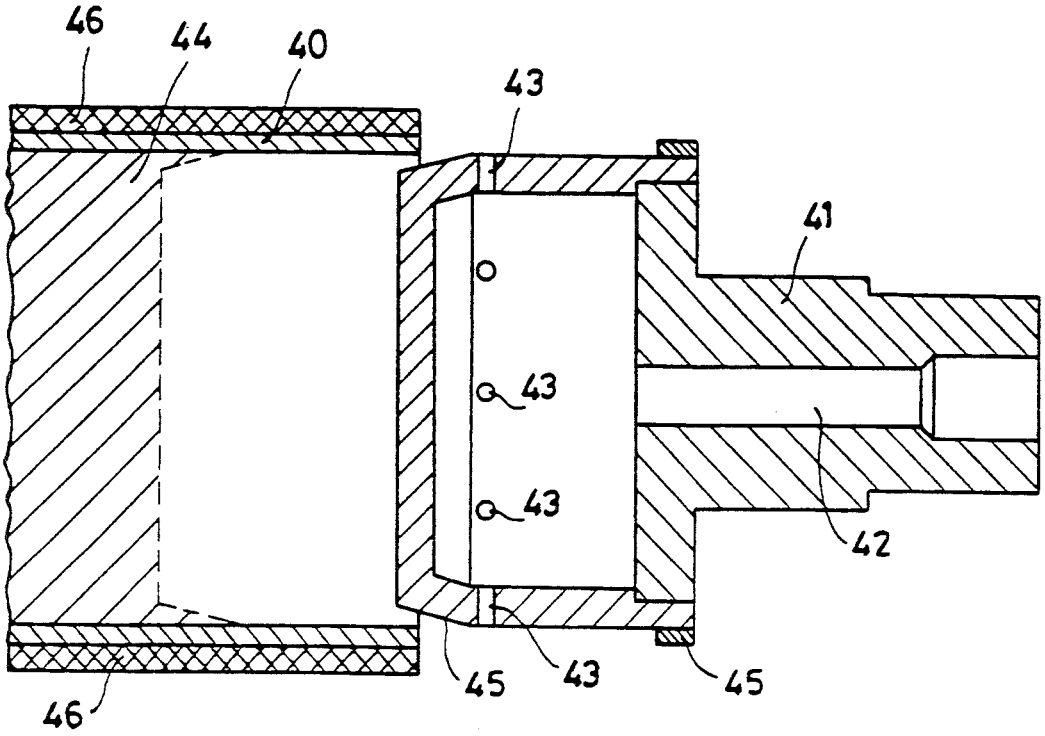
FIG. 5 shows a schematic view in cross-section for fixing a journal in the end of a roller casing.

Finally, FIG. 5 shows on an enlarged scale how a journal 41 can be fixed in the end of a roller casing 40 which is previously filled with a foam plastic filling 44 using temporary sealing plugs. The temporary sealing plugs are removed and for the fitting of the journal 41 the journal is pushed by means of chamfers 45 over a short distance into the end of the roller casing 40 in such a way that the apertures 43 are covered. Medium under pressure, for example compressed air, is then fed to the interior of the journal, so that air flows through the apertures 43 and a slight elastic stretch is given to the roller casing 40. In this way the journal is easy to slide into the roller casing end up to the stop 45. The roller thus obtained is of particularly low weight, and a low starting couple is therefore sufficient for all the normal applications relating to the guidance of conveyed film or other such substrates.

Reference number 46 indicates that the roller casing 40 can be covered by an adhering or non-adhering covering of, for example, rubber (adhering) or metal (non-adhering). In the latter case a seamless nickel sleeve can be fitted in a very tight-fitting manner around the roller casing 40 by means of air push-on techniques.

What is claimed is:

1. A method for the manufacture of a roller with a form retaining external surface, the method comprising:

electrodepositing a metal roller casing on a cylindrical metal mold, removing the metal roller casing from the mold for defining the cylindrical metal casing;

installing and fixing roller shaft means in the form of journals in the ends of the roller casing and closing off the ends of the casing; and rigidifying the roller casing by installing a low density filler inside the roller casing between the journals.

2. The method of claim 1, wherein the filler inside the casing is a plastic foam product.

3. The method of claim 2, wherein the plastic foam product is installed in the casing before the journals are placed in the ends of the casing.

4. The method of claim 2, wherein the plastic foam product is installed in the casing after the journals have been placed in the ends of the casing.

5. The method of claim 1, wherein the placing of the journals in the ends of the casing comprises placing the journals in the casing in a sealing manner;

introducing a gas under pressure inside the roller casing which is sealed by the journals and shutting off the space inside the roller after a predetermined pressure has been reached.

6. The method of claim 5, wherein the gas pressure in the space is raised to at least 1.3 atm. (gauge).

7. The method of claim 1, further comprising surface treating the roller casing while it is on the mold and before it is removed from the mold for giving the external surface of the casing a texture for subsequent use.

8. The method of claim 7, wherein the surface treatment is selected from the group of operations consisting of forming grooves, forming recesses, grinding, turning, etching, electrodeposition of additional metal layers, and electrodeposition of metal patterns.

9. The method of claim 1, further comprising installing a metal inner casing having an external diameter which is smaller than the internal diameter of the roller casing, inside the roller casing, fixing the inner casing concentrically in the roller casing through using the journals to permit centered accommodation of the roller casing and the inner casing; and the installing of a filler inside the roller casing comprises at least installing the low density filler at least in the space between the roller casing and the inner casing to fill that space.

10. The method of claim 9, further comprising filling the space inside the inner casing with a filler.

11. The method of claim 10, wherein the space between the roller casing and the inner casing is filled with a filler comprising foam plastic of a lower density and the space inside the inner casing is filled with a filler comprising foam plastic of a higher density.

12. The method of claim 3, wherein the filling of the roller casing comprises temporarily placing centering sealing plugs in the ends of the roller casing, the plugs having openings therethrough for passage therethrough of plastic foam product, supplying plastic foam product through the openings in the temporary sealing plugs into the casing, thereafter removing the sealing plugs and placing journals in the roller casing in place of the sealing plugs for closing the ends of the roller casing.

13. The method of claim 12, wherein each of the sealing plugs is further provided with at least one aperture which opens out on the periphery of the sealing plug; feeding a medium under pressure through the apertures in the sealing plugs for causing temporary slight enlargement of the diameter of the roller casing at the ends of the casing at the sealing plugs, which enables emplacement and removal of the sealing plugs while the pressure medium is being supplied.

14. The method of claim 1, wherein each of the journals is further provided with at least one aperture which opens out on the periphery of the journal; feeding a medium under pressure through the apertures in the journals for causing temporary slight enlargement of the diameter of the roller casing at the ends of the casing at the journals, which enables emplacement and removal of the journals while the pressure medium is being supplied.

15. The method of claim 1, further comprising applying a covering to the thin metal roller casing.

16. The method of claim 1, further comprising applying an adhering covering of a plastic material to the metal roller casing.

17. The method of claim 15, wherein the covering is applied by temporarily enlarging in diameter a sleeve covering, sliding the sleeve around the roller casing, and when the sleeve has been positioned around the roller casing, returning the sleeve to its original reduced diameter.

18. A roller comprised of a roller casing which is formed according to the method of claim 1, and wherein the roller casing is a seamless nickel sleeve having a thickness in the range between 100 and 500 μm.

19. A roller comprised of a roller casing which is formed according to the method of claim 14, and wherein the roller casing is a seamless nickel sleeve having a thickness in the range between 100 and 500 μm.

* * * * *